United States Patent [19]

Bain et al.

[11] Patent Number: 5,008,085

[45] Date of Patent: Apr. 16, 1991

[54] APPARATUS FOR THERMAL TREATMENT OF A HYDROCARBON STREAM

[75] Inventors: Richard L. Bain, Golden; John R. Larson, Boulder, both of Colo.

[73] Assignee: Resource Technology Associates, Tulsa, Okla.

[21] Appl. No.: 332,508

[22] Filed: Mar. 31, 1989

Related U.S. Application Data

[63] Continuation-in-part of Ser. No. 58,878, Jun. 5, 1987, Pat. No. 4,818,371.

[51] Int. Cl.[5] ..... G05D 7/00

[52] U.S. Cl. ..... 422/109; 422/111; 422/112; 422/197; 422/307; 210/747; 210/758; 210/761; 166/59; 196/132

[58] Field of Search ..... 422/111, 242, 197, 109, 422/112, 307; 166/58, 59, 64, 222, 223, 300; 210/747, 758, 761; 208/3, 7, 106; 196/46, 132

[56] References Cited

U.S. PATENT DOCUMENTS

| | | | |
|---|---|---|---|
| 895,229 | 8/1908 | Beddoes | 37/67 |
| 1,449,227 | 3/1923 | Hanna et al. | 208/106 |
| 1,479,653 | 1/1924 | Davidson | 208/113 |
| 1,514,098 | 11/1924 | Palmer | 208/110.6 |
| 1,610,523 | 12/1926 | Hess | 208/103 |
| 1,828,691 | 10/1931 | Stransky et al. | 208/113 |
| 2,135,332 | 11/1938 | Gary | 196/62 |

(List continued on next page.)

FOREIGN PATENT DOCUMENTS

| | | | |
|---|---|---|---|
| 1184523 | 3/1985 | Canada | 196/164 |
| 1189011 | 6/1985 | Canada | 196/174 |
| 420650 | 8/1974 | U.S.S.R. | 208/116 |

OTHER PUBLICATIONS

"Conversion of Petroleum", A. N. Sachanen, D. Sc., Reinhold Publishing Corporation, N.Y., 1948, pp. 252–254.

"Visbreaking . . . Still the Basic Process for Fuel Reduction", M. G. Boone and D. F. Ferguson, The Oil and Gas Journal, Mar. 22, 1954, pp. 166–168, 211, 213.

"Visbreaking: A Flexible Process", A. Rhoe and C. de Blignieres, Hydrocarbon Processing, Jan. 1979, pp. 131–136.

"Visbreaking: More Feed for FCC", R. Hournac, J. Kuhn and M. Notarbartolo, Hydrocarbon Processing, Dec., 1979, pp. 97–102.

"Visbreaking Process Has Strong Revival", Martin Hus, Technology Oil and Gas Journal, Apr. 13, 1981, vol. 79, pp. 109–120.

"Thermal Visbreaking of Heavy Residues", H. Beuther, R. G. Goldthwait, and W. C. Offutt, The Oil and Gas Journal, Nov. 9, 1959, vol. 57, No. 46, pp. 151–157.

"Rebuilding Hydrocarbons", W. L. Nelson, Petroleum Refinery Engineering, 4th Ed. McGraw-Hill Book Company, Inc. (1958), pp. 699–702, 719.

"Waste Treatment Process Keyed to Mile-Long Reactor", G. Rappe, Chemical Engineering, Apr. 15, 1985, pp. 44–45.

*Primary Examiner*—David L. Lacey
*Assistant Examiner*—Jeffrey R. Snay
*Attorney, Agent, or Firm*—Sheridan, Ross & McIntosh

[57] ABSTRACT

An apparatus is disclosed for improving the transportability of a hydrocarbon stream by reducing its viscosity. The apparatus comprises a reactor vessel useful for providing an incremental amount of heat to a hydrocarbon stream by the introduction of an oxidizing agent into the core portion of the stream. The reactor comprises an influent conduit and an effluent conduit in heat exchange relation with each other, at least one oxidant injection nozzle located in either or both the influent and/or effluent conduits, a conduit to transport oxidant to the nozzles and a valve in the oxidant conduit to control oxidant flow to the nozzles. The reactor can also contain temperature monitors in the influent and/or effluent conduits and an oxidant flow controller device responsive to output from the temperature monitors and adapted to adjust oxidant flow to maintain temperatures in the reactor reaction zone within a preselected range.

3 Claims, 4 Drawing Sheets

U.S. PATENT DOCUMENTS

| | | | |
|---|---|---|---|
| 2,160,814 | 6/1939 | Arveson | 196/50 |
| 2,421,528 | 6/1947 | Steffen | 166/21 |
| 2,587,703 | 3/1952 | Deanesly | 196/65 |
| 2,651,601 | 9/1953 | Taff et al. | 196/73 |
| 2,752,407 | 6/1956 | Cahn | 260/683 |
| 2,818,419 | 12/1957 | McKinley et al. | 260/451 |
| 2,844,452 | 7/1958 | Hasche | 48/196 |
| 2,862,870 | 12/1958 | Voorhies, Jr. | 208/56 |
| 2,900,327 | 8/1959 | Beuther | 208/106 |
| 2,937,987 | 5/1960 | Jenkins | 208/108 |
| 2,981,747 | 4/1961 | Lang et al. | 208/3 |
| 3,132,088 | 5/1964 | Beuther et al. | 208/67 |
| 3,140,986 | 7/1964 | Hubbard | 202/52 |
| 3,156,642 | 11/1964 | Trantham et al. | 208/120 |
| 3,170,863 | 2/1965 | Spillane et al. | 208/3 |
| 3,306,839 | 2/1967 | Vaell | 208/59 |
| 3,310,109 | 3/1967 | Marx et al. | 166/7 |
| 3,320,154 | 5/1967 | Tokuhisa et al. | 208/130 |
| 3,324,028 | 6/1967 | Beuther et al. | 208/89 |
| 3,371,713 | 3/1968 | Silverman | 166/38 |
| 3,412,011 | 11/1968 | Lindsay | 208/113 |
| 3,439,741 | 4/1969 | Parker | 166/272 |
| 3,442,333 | 5/1969 | Meldau | 166/272 |
| 3,449,247 | 6/1969 | Bauer | 210/63 |
| 3,464,885 | 9/1969 | Land | 162/17 |
| 3,474,596 | 10/1969 | Scott et al. | 55/45 |
| 3,496,097 | 2/1970 | Engle | 208/208 |
| 3,523,071 | 8/1970 | Knapp et al. | 208/14 |
| 3,606,999 | 9/1971 | Lawless | 23/1 |
| 3,738,931 | 6/1973 | Frankovich et al. | 208/67 |
| 3,767,564 | 10/1973 | Youngblood et al. | 208/92 |
| 3,775,296 | 11/1973 | Chervenak et al. | 208/108 |
| 3,803,259 | 4/1974 | Porchey et al. | 260/683 R |
| 3,853,759 | 12/1974 | Titmas | 210/63 |
| 3,948,755 | 4/1976 | McCollum et al. | 208/11 |
| 3,984,305 | 10/1976 | Hosoi et al. | 208/57 |
| 3,989,618 | 11/1976 | McCollum et al. | 208/106 |
| 4,042,487 | 8/1977 | Seguchi et al. | 208/48 R |
| 4,089,340 | 5/1978 | Smith et al. | 137/13 |
| 4,248,306 | 2/1981 | VanHuisen | 166/305 R |
| 4,252,634 | 2/1981 | Khulbe et al. | 208/48 R |
| 4,272,383 | 6/1981 | McGrew | 210/741 |
| 4,298,455 | 11/1981 | Huang | 208/48 AA |
| 4,298,457 | 11/1981 | Oblad et al. | 208/107 |
| 4,334,976 | 6/1982 | Yan | 208/8 LE |
| 4,354,922 | 10/1982 | Derbyshire et al. | 208/68 |
| 4,379,747 | 4/1983 | Yan | 208/251 H |
| 4,428,828 | 1/1984 | Bose | 208/208 R |
| 4,432,864 | 2/1984 | Myers et al. | 208/120 |
| 4,446,012 | 5/1984 | Murthy | 208/130 |
| 4,448,665 | 5/1984 | Zaczepinski et al. | 208/8 LE |
| 4,454,023 | 6/1984 | Lutz | 208/96 |
| 4,461,743 | 6/1984 | Chowdhury et al. | 422/129 |
| 4,469,587 | 9/1984 | Tailleur et al. | 208/61 |
| 4,478,705 | 10/1984 | Ganguli | 208/59 |
| 4,481,101 | 11/1984 | Yan | 208/50 |
| 4,508,614 | 4/1985 | Yan | 208/78 |
| 4,522,703 | 6/1985 | Yan et al. | 208/106 |
| 4,560,467 | 12/1985 | Stapp | 208/89 |
| 4,564,458 | 1/1986 | Burleson | 210/761 X |
| 4,631,384 | 12/1986 | Cornu | 219/121 |
| 4,648,964 | 3/1987 | Leto et al. | 208/390 |
| 4,671,351 | 6/1987 | Rappe | 165/133 |
| 4,741,386 | 5/1988 | Rappe | 165/48 |
| 4,744,908 | 5/1988 | Peterscheck et al. | 210/747 |
| 4,778,586 | 10/1988 | Bain et al. | 208/132 |
| 4,981,747 | 4/1961 | Lang et al. | 260/451 |

APPARATUS FOR THERMAL TREATMENT OF A HYDROCARBON STREAM

CROSS-REFERENCE TO RELATED APPLICATION

This application is a continuation-in-part of copending and commonly assigned U.S. patent application Ser. No. 058,878, filed June 5, 1987, now U.S. Pat. No. 4,818,371, and entitled "Viscosity Reduction by Direct Oxidative Heating."

FIELD OF THE INVENTION

This invention relates to an apparatus in which the viscosity of hydrocarbons can be reduced through thermal treatment, thereby improving the transportability of the hydrocarbons.

BACKGROUND OF THE INVENTION

Vertical tube reactors which use a subterranean U-tube configuration for providing a hydrostatic column of fluid sufficient to provide a selected pressure are known. This type of reactor has been primarily used for the direct wet oxidation of materials in a waste stream but may also be used for pyrolysis, alkylation, hydrolysis and hydrogenation of waste streams. As exemplified by the following patents, reactors of this nature typically comprise a subterranean vertical U-tube reactor system consisting of influent and effluent conduits concentrically arranged for heat exchange, a reaction zone at the bottom of the reactor, and in some cases, a jacket containing heated media for the external heating of the reaction zone, and pipes to supply oxygen or other reactant gases.

Bauer, U.S. Pat. No. 3,499,247 (1969), discloses a method for the wet oxidation of fluid sewage mixed with combustible refuse. Air is pumped into the influent stream at the well head and is pumped directly into the reaction zone from a subterranean compressed air storage chamber. Pressure in the reaction zone produced by the hydrostatic head may be augmented by a pressure regulating device on the effluent stream.

Lawless, U.S. Pat. No. 3,606,999 (1971), discloses a method and apparatus for carrying out oxidation of sewage or aqueous industrial waste. In addition to the U-tube conduits, the apparatus includes gas venting and supply lines, floats and sparges. Air and/or other reactant gases are introduced to the reaction zone through gas lines travelling down the feed pipe (inner conduit) to the sparges. Air released from the sparges and product gases are trapped in the floats, lending buoyancy to the same. The floats are used to support the feed pipe.

Land U.S. Pat. No. 3,464,855 (1969), discloses a method for the aqueous digestion of wood chips. The patent discloses a variation on the U-tube apparatus in that the well installations contain at least three concentric annular passages. Countercurrent coaxial flow paths containing the wood chip solution comprise two of the annular spaces. The coaxial flow paths are in fluid communication with each other at the soaking reservoir at the well bottom. Additional annular spaces, which are not in fluid communication with reactant materials in the countercurrent coaxial flow paths, are described as carrying steam or other heated fluids to serve as a source of external heat to reactant material in surrounding annular spaces. A valve or plate on the reaction product effluent and a reactant influent pump augment the hydrostatic pressure of material within the coaxial pathways.

Titmas U.S. Pat. No. 3,853,759 (1974), discloses a method for pyrolysis, alkylation, hydrolysis and hydrogenation of raw sewage and for the devulcanization of aqueous rubber solutions in an oxygen deficient environment. Titmas has a steam or heat energy line running axially down the center of the liner (inner conduit) to deliver steam or other heated media to the reaction zone. The reaction zone is within an orifice created by annular rings arranged on the inner surface of the liner and the outer surface of the steam line; steam or other heated medium is injected into the orifice to maximize pressure and temperature in the orifice area. The liner conduit may be suspended for the purposes of accommodating metal expansion upon heating.

McGrew U.S. Pat. No. 4,272,383 (1981), discloses a method and apparatus for the wet oxidation of sewage sludge. The first or outer conduit of the U-tube has a closure at its lower end and the second or inner conduit terminates and is suspended above the outer conduit closure. The reaction zone, which is located within the bottom portion of the outer conduit, is temperature controlled by heat exchange with a heated media in a surrounding annular jacket. The apparatus further comprises a pump for pumping influent into the downgoing flow pipe. Oxygen or other reactant gas may be introduced into the downgoing flow passage at the surface and at inlets at spaced intervals below the ground surface level to form enlarged "Taylor" gas bubbles within the influent.

Bain U.S. Pat. No. 4,778,586 (1988), discloses a method and apparatus for the treatment of whole crude to reduce its viscosity and render it more suitable for transportation by pipeline or ship. The U-tube apparatus contains three concentric annular passages. Two of these passages, the downcomer and the riser, contain the hydrocarbon stream and are in fluid communication with each other at the well bottom in the reaction zone. The third annular passage is a jacket located adjacent to portions of the riser and downcomer corresponding to the reaction zone. The heat exchange fluid circulated through the jacket provides the external source of heat used to raise the temperature of the stream to the reaction temperature. Temperature sensors in or above the reaction zone can be used to control the temperature of the jacket heat exchange fluid and minimize formation of coke on conduit walls.

Although the U-tube configuration of the above-cited patents contain inner and outer conduits in heat exchange relationship, annular jackets surrounding the reaction zone with heating media therein and/or air or gas conduits at a variety of locations and depths, none of the patents suggest or disclose an apparatus which would be useful for the direct oxidative heating of a hydrocarbon stream. Further, none of these patents suggest or disclose the central placement and downstream orientation of oxidant nozzles in the stream within the reaction zone, feedback control relationship between oxidant conduit valves, which control the oxidant flow rate to the nozzles, and temperature monitors located in or above the reaction zone.

The present invention involves an apparatus useful in the method described in copending and commonly assigned application, "Improved Viscosity Reduction by Direct Oxidative Heating," Ser. No. 058,878, filed June 5, 1987, now U.S. Pat. No. 4,818,371 incorporated in its entirety herein by reference. Said application describes a method for providing direct oxidative heating of hydrocarbon material to reduce viscosity thereof with reduced coke formation on reactor walls. The method of Ser. No. 058,878 involves direct heating of the hydrocarbon influent stream by dispensing an oxidant centrally in the influent stream, rather than external heating of the influent stream by using heating elements or media in a jacket in heat exchange relationship with the conduit containing the reaction zone. The apparatus of the present invention uses central placement and downstream orientation of oxidant nozzles in the hydrocarbon stream within the reaction zone to achieve the direct oxidative heating described in the process of Serial No. 058,878. The present invention further involves a feedback control mechanism between temperature monitors in or above the reaction zone and oxidant conduit valves.

SUMMARY OF THE INVENTION

The present invention comprises an apparatus useful for reducing the viscosity of a hydrocarbon stream by direct oxidative heating. A vertical tube reactor is disposed within a substantially vertical well bore in the earth. The reactor comprises an influent conduit and an effluent conduit. The influent conduit is in fluid communication with the effluent conduit with each of said conduits having an upper and a lower zone. The influent conduit is adapted to receive an influent hydrocarbon stream and conduct the stream substantially downward. The effluent conduit is adapted to conduct an effluent product stream substantially upward. The upper zones of the conduits are adapted to bring the influent stream and effluent product stream into heat exchange contact with one another and produce a heated influent stream. An oxidant injection nozzle is located within at least one of the lower zones and is adapted to introduce oxidant into the core portion of the heated influent stream substantially parallel with and in the direction of the flow of the stream. The resulting reaction between the oxidant and hydrocarbons in the stream produces the product stream.

In another embodiment, the instant invention comprises the foregoing apparatus in which an oxidant conduit is located within the well bore and travels substantially parallel to the influent and effluent conduits. The oxidant conduit is operatively connected with the oxidant injection nozzle to supply oxidant to said nozzle. The apparatus can also comprise a means for controlling the flow rate of the oxidant within the oxidant conduit. The controlling means is operatively associated with the oxidant conduit and is adapted to adjust the flow rate of oxidant through the oxidant conduit.

In another embodiment, the apparatus of the instant invention comprises a temperature sensing means located downstream of the nozzle. The temperature sensing means is adapted to detect the temperature of the hydrocarbon stream and provide an output proportional to said temperature.

In a further embodiment, the apparatus of the instant invention comprises a vertical tube reactor disposed within a substantially vertical well bore. The apparatus comprises concentrically arranged inner and outer conduits having an upper and lower zone. The influent conduit is adapted to receive an influent hydrocarbon stream and conduct the stream substantially downward. The effluent conduit is adapted to conduct an effluent product stream formed from said influent stream substantially upward. The conduits provide heat exchange contact between the influent stream and the effluent product stream to produce a heated influent stream. An oxidant injection nozzle is located within the lower zone of the effluent conduit. The nozzle is adapted to introduce oxidant into the core portion of the heated influent stream substantially parallel to and with the flow of the stream to produce the effluent product stream. At least one means for sensing temperature is located within the effluent conduit downstream from the nozzle and is adapted to produce an output proportional to the temperature. A conduit for conducting oxidant from the surface of the well bore to the nozzle is located within the inner conduit, travels substantially parallel to the conduit and is connected to the nozzle. A means for controlling the flow rate of oxidant within said oxidant conduit is operatively associated with the oxidant conduit. This control means is adapted to be adjusted in response to output from the temperature sensing means and change the oxidant flow rate in a preselected proportion to the output. In a further embodiment, this apparatus comprises at least two oxidant injection nozzles spaced longitudinally apart in the effluent conduit. Each of the nozzles is separately associated with a means for controlling the flow rate of oxidant. The association is adapted to provide separate control of oxidant flow to each of said nozzles.

BRIEF DESCRIPTION OF THE INVENTION

Figure 1:
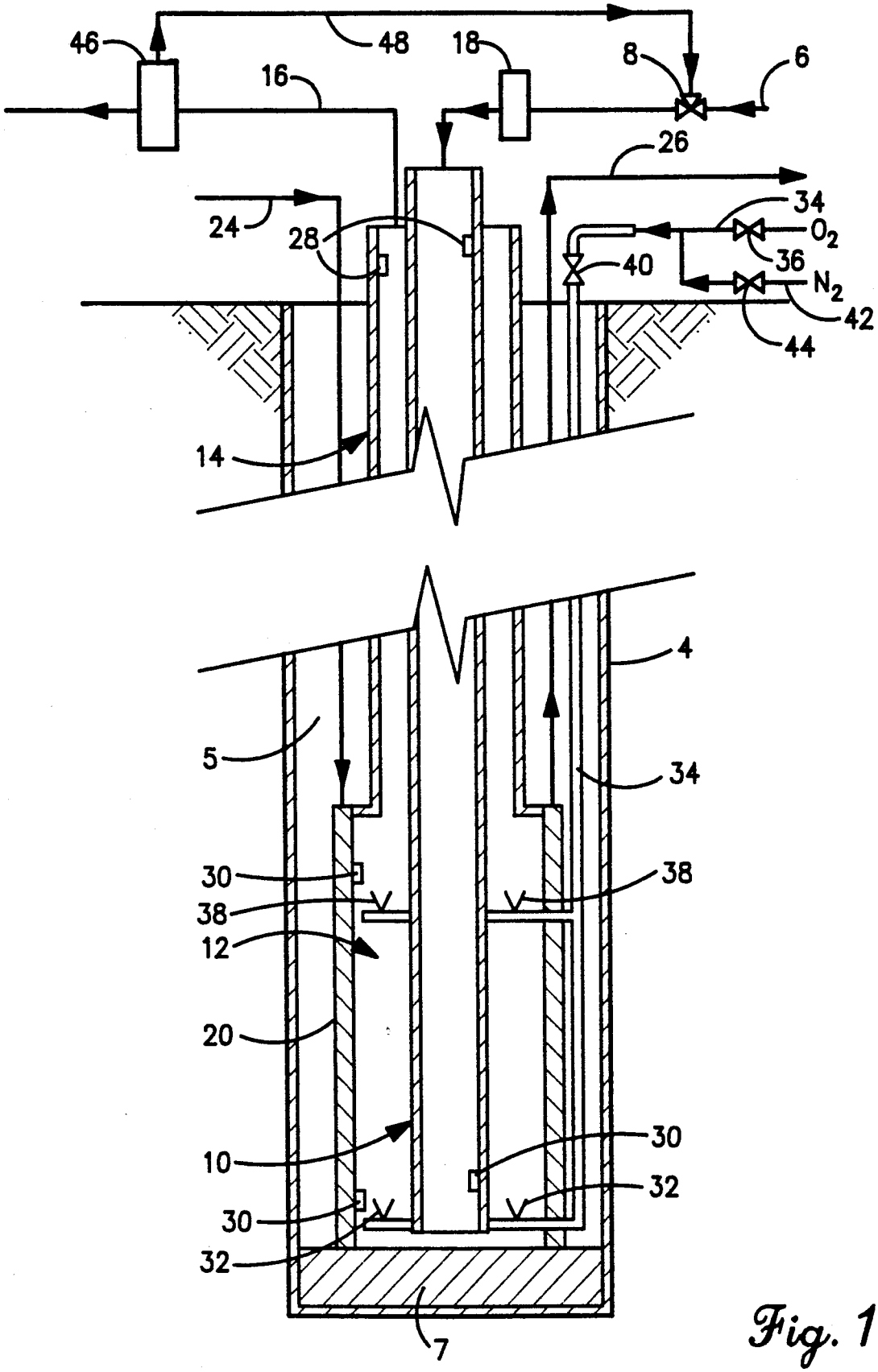
FIG. 1 is a schematic representation of a preferred embodiment of the present invention.

As used herein, the term "boundary layer" is defined as the thin layer of the hydrocarbon stream immediately adjacent to reactor walls or other stationary surfaces in the reactor vessel, this layer being characterized by very low fluid velocities.

As used herein, the term "core portion" is defined as the portion of the hydrocarbon stream other than the boundary layer which is characterized by flow velocities which are higher than boundary layer flow velocities. The core portion can be in laminar or turbulent flow.

As used herein, the term "bulk temperature" is defined as the average temperature in a cross-sectional segment of the core portion in the hydrocarbon stream in which there is sufficient mixing of the stream to achieve a substantially uniform temperature throughout the segment.

As used herein, the term "coking temperature" is defined as a bulk temperature at which there is at least about 0.5 weight percent solid coke formation in a 24 hour period (based on the hydrocarbon stream).

As used herein, the "reaction pressure" is defined as a pressure or range of pressures in the reaction zone at which the rate of viscosity reduction is substantially increased.

As used herein, a hydrocarbon stream in "multiphase flow" means a stream containing a component that, under pressure and temperature conditions existing during heat exchange between the influent and effluent streams, is gaseous and causes the flow of said stream to be turbulent. However, under pressure and temperature conditions greater than those in the heat exchange area, including those conditions in the reaction zone, the component is liquid.

The present invention involves a reactor vessel apparatus useful for providing an incremental amount of heat to a hydrocarbon stream by introducing an oxidizing agent into the core portion of the stream. The reactor vessel is comprised of an influent conduit and an effluent conduit in heat exchange relation with each other, at least one oxidant injection nozzle located in either or both the influent and/or effluent conduits, a conduit adapted to transport oxidant to the nozzles and valve means in the oxidant conduit to control oxidant flow to the nozzles. Additionally, the apparatus can further comprise one or more of the following elements: a heat exchange area located above and in fluid communication with the influent and effluent conduits for use in heating the influent stream; a heater above and in fluid communication with the influent conduit for heating the influent stream; a pump to increase the initial pressure of the hydrocarbon stream; static mixers in the reaction zone; emergency apparatus to flood the oxidant lines with inert or non-reactive gas to avoid an explosion in the event hydrocarbon stream enters the oxidant line; an additional annular space or jacket surrounding the portion of conduit corresponding to the reaction zone with heated media therein to externally heat the reaction zone; a conduit to receive the effluent stream from the effluent conduit and conduct it to a separation/compression unit; one or more temperature monitors in the conduits; one or more pressure monitors in the conduits; and/or a conduit to convey gas or volatile liquids from the separation/compression unit to the influent conduit for mixing with the influent stream.

Application Ser. No. 058,878, discloses a process in which an incremental amount of heat is added to a hydrocarbon stream by introducing an oxidizing agent into the core portion of the stream. The oxidizing agent rapidly oxidizes components in the stream in an exothermic oxidation reaction. By distributing this heat in the moving stream, an increase in the bulk temperature of the stream is provided. This increased bulk temperature or "reaction temperature" is the temperature at which the rate of viscosity reduction is substantially increased. The oxidation reaction is controlled so that the increased bulk temperature (reaction temperature) is below the coking temperature. Maintaining the bulk temperature below the coking temperature limits the temperature of the boundary layer in the reactor vessel which prevents excessive formation of coke on the walls of the reactor vessel.

The viscosity of a hydrocarbon feed can be significantly reduced without the formation of substantial coke deposits on the walls of the reactor vessel. While the process of coking is not fully understood, it has been reported that increased severity of conditions increase coke formation. It is known that materials such as asphaltenes are more likely to form coke. Once these materials precipitate and solidify on surfaces, it is difficult to dissolve them before coke deposits are formed. Coke tends to build on the reactor wall or other heating surface because in most systems these surfaces must be heated significantly above the desired reaction temperature to attain bulk temperatures sufficient to effect acceptable rates of viscosity reduction. Such "external heating" promotes coke formation on reactor walls. As used herein, the term "external heat source" does not apply to the heat provided to the influent stream by thermal communication with the effluent product stream.

The direct oxidative heating process disclosed in application Ser. No. 058,878 minimizes these problems associated with external heating. The increment of heat necessary to increase the bulk temperature of the stream to effect substantially increased rates of viscosity reduction is provided by internal heating through direct oxidation of components in the core portion of the stream. Consequently, coke formation on reactor walls or other surfaces in the reactor vessel is substantially reduced since these surfaces and the boundary layer of feed adjacent to the surfaces are not heated above the coking temperature.

While practice of the direct oxidative heating process substantially reduces formation of coke on reactor vessel walls, some coke formation can occur over time. The amount of coke build-up is affected by the type of feed, the quantity of feed which is processed as well as process conditions. While some coke build-up can be tolerated in most viscosity reduction processes, the direct oxidative heating process is less sensitive to coke formation than systems which rely entirely on external heating. Coke formation on reactor walls insulates the reactor and decreases the amount of heat added to the stream by an external heat source. To maintain required temperatures for viscosity reduction, external heat must be increased which causes additional coke formation. However, there is a significant advantage in the direct oxidative heating process since coke formation in the reactor does not require additional external heating because the final increment of heat is provided internally. The amount of coke formation in such a process which would necessitate a decoking procedure depends on the particular reaction vessel in use and the point at which the operation becomes impaired by coke buildup.

In the direct oxidative heating process, the exothermic reaction is controlled so that the bulk temperature remains below the coking temperature. It should be appreciated that between the region in the reactor vessel where the oxidation reaction occurs and where mixing of the stream has achieved a substantially uniform temperature throughout a cross-sectional segment of the stream, localized temperatures above the coking temperature can occur. Such temperatures can cause some coke formation in the stream. These coke particles, however, can be substantially prevented from adhering to any surfaces by the physical action of the flow of the stream.

The direct oxidative heating process of Ser. No. 058,878 is broadly applicable to reducing the viscosity of hydrocarbon feeds. The terms "hydrocarbon stream" and "hydrocarbon feed" are used interchangeably herein to mean a liquid stream which contains primarily hydrocarbonaceous components but can also contain smaller amounts of other components, for example, water. This process is especially useful for treating heavy oil crudes of a nature and viscosity which renders them unsuitable for direct pipeline transport. This includes feeds having a viscosity above about 1000 centipoise (cp) at 25° C. (unless otherwise indicated, viscosity referred to herein is at 25° C.), a pour point above about 15° C. or an API gravity at 25° C. of about 15° and below. The advantages of reduced viscosity, increased API gravity and/or reduced pour point can be achieved in the instant apparatus without regard to the initial viscosity, API gravity or pour point of the feed. Additionally, if desired, a diluent can be added to the feed stream or to the reaction product from the process in order to further reduce the viscosity. Heating of the product in order to reduce the viscosity or maintain an acceptable viscosity for a particular pipeline or transportation medium is also possible.

Hydrocarbon feeds which can be used in the present apparatus include, but are not limited to, heavy whole crude oil, tarsands, bitumen, kerogen, and shale oils. Examples of heavy crude oil are Venezuelan Boscan crude oil, Canadian Cold Lake crude oil, Venezuelan Cerro Negro crude oil and California Huntington Beach crude oil. In practice, the most significant reductions in viscosity are achieved when the starting feed is more viscous.

The vertical tube reactor apparatus of the instant invention has a heat exchange section, a combustion zone, and a reaction zone. The heat exchange section is adapted to provide for heat exchange between the influent hydrocarbon feed stream and the effluent product stream. The combustion zone is the region in which oxidizing agent is introduced into the core portion of the hydrocarbon stream and oxidizes components in the stream. The reaction zone is the region in which the bulk temperature of the hydrocarbon stream is greater than the maximum temperature achieved by heat exchange. There can be substantial overlap between the combustion zone and the reaction zone.

In the direct oxidation process of Ser. No. 058,878, the hydrocarbon feed stream comprising a core portion and a boundary layer is introduced into the inlet of the vertical tube reactor. The influent hydrocarbon stream is at a first temperature ($T_1$) and an initial pressure ($P_1$). As the influent hydrocarbon stream travels down the influent conduit of the vertical tube reactor, the pressure increases due to the hydrostatic column of fluid. Additionally, the temperature of the influent stream increases to a second temperature ($T_2$) due to heat exchange with the effluent product stream. An oxidizing agent is introduced into the core portion of the hydrocarbon stream to increase the bulk temperature of the hydrocarbon stream to a preselected reaction temperature ($T_{rx}$).

It is preferred that the difference between the second temperature and the reaction temperature is small because less feed must be consumed in the oxidation reaction to provide the necessary heat and fewer oxidation products are formed. Additionally, the greater the temperature difference, the larger the combustion zone which is needed to provide the necessary heat to increase the bulk temperature of the stream from the second temperature to the reaction temperature. It is preferred that the temperature increment between the reaction temperature and the second temperature of the hydrocarbon stream is less than about 35° C. and more preferably less than about 25° C.

In order to achieve the second temperature ($T_2$) necessary for the process to operate efficiently, it is necessary for the heat exchange between the influent hydrocarbon stream and the effluent product stream to be more efficient than those disclosed in the known patents relating to vertical tube reactors. The temperature of the influent stream achievable by heat exchange with the reaction product is limited by a number of factors including the temperature of the reaction product, the heat exchange surface area, and the velocities of the hydrocarbon streams. In order to achieve the necessary heat exchange efficiencies, it has been found that at least one of and preferably both the influent feed stream and the product stream are in substantially vertical multiphase flow. It has been found that when both streams are in substantially vertical multiphase flow an increase in heat exchange efficiency of at least about 100% can be achieved compared to heat exchange when neither stream is in multiphase flow. This allows a second temperature ($T_2$) to be attained which is sufficiently close to the necessary reaction temperature to allow direct oxidative heating by introducing an oxidizing agent.

The oxidizing agent is a material which rapidly exothermically oxidizes the hydrocarbon feed under chosen reaction conditions. The agent is selected so that essentially all of the agent reacts with the feed. Various oxidizing agents are suitable for use in this process. Such agents include, but are not limited to oxygen and hydrogen peroxide. The oxidizing agent can be optionally mixed with a nonreactive gas, such as nitrogen, and air or enriched air can be used in the present process. Preferably enriched air is used.

The amount of the oxidizing agent injected into the hydrocarbon stream affects the amount of heat generated by the oxidation reaction and is the primary factor for controlling the temperature increase in the stream from the oxidation reaction. The amount of oxidizing agent required for a particular volume of hydrocarbon feed in operation of the invention can be substantially defined with four variables: (1) the heat required to raise the temperature of that volume of the feed from the second temperature to a reaction temperature, (2) the heat of cracking of that volume of the feed, (3) the heat loss from that volume of the feed to the environment in the reaction zone, and (4) the heat of combustion of the particular feed. The sum of the first three of these quantities equal the amount of heat that must be generated from the oxidation of some portion of the feed. The amount of feed which must be oxidized depends on the heat of combustion of the particular feed.

With regard to the variables discussed above, it is apparent that as the difference between the second temperature and the reaction temperature increases an increased flow rate of oxidizing agent is necessary to generate additional heat by the oxidation of a larger amount of the feed. As stated above, the amount of oxidizing agent required in the process is also dependent on the heat of cracking of the feed. This characteristic is variable between feeds. The oxidizing agent flow rate is also affected by heat loss from the hydrocarbon stream to the environment. A greater heat loss requires more heat generation initially and, therefore, the use of more oxidizing agent.

In the direct oxidative heating process, the amount of oxidizing agent introduced to the reactor vessel is used to control the oxidation reaction. The desired flow rate for a given concentration can be estimated by calculation using the variables discussed above. If the exact value for each variable is known, the amount of oxidizing agent required (assuming the heat of oxidation is known) can be determined. In practice, these values must ordinarily be estimated. Such an estimate can be used to determine an initial flow rate of oxidizing agent to use; however, actual control is based on a measured variable such as the bulk temperature of the hydrocarbon stream. The bulk temperature downstream from the oxidation reaction is ordinarily monitored. The bulk temperature should remain below the coking temperature so that the reactor walls and boundary layer are not heated to a temperature at which excessive coke formation occurs. If the bulk temperature becomes too high, the flow of oxidizing agent is reduced until the preselected bulk temperature is attained. If the bulk temperature is too low to achieve acceptable viscosity reduction, the amount of oxidizing agent introduced into the stream is increased until the appropriate reaction temperature is attained. Monitoring the pressure in the reaction zone can also be used to control the amount of oxidizing agent introduced into the hydrocarbon stream. The detection of pressure surges or fluctuations indicates that the amount of oxidizing agent being introduced into the hydrocarbon stream should be decreased.

As used herein, the term "reaction temperature" refers to the maximum bulk temperature of the hydrocarbon stream reached in the process. It is understood that some thermal cracking can occur at lower temperatures. The term "reaction zone" refers to the region in the process which begins at the point the oxidizing agent is introduced and ends where heat exchange between the reaction product effluent stream and the influent hydrocarbon stream begins. The maximum useful bulk temperature in the process is the coking temperature of the particular feedstock. In ordinary operation, the bulk temperature of the hydrocarbon stream is maintained below the coking temperature. At a minimum, the reaction temperature used for practice of the process is high enough to initiate some thermal cracking reaction. For most feeds, the reaction temperature is above about 300° C. and less than about 475° C., more typically in the range of about 350° C. to about 450° C., and more often in the range of about 375° C. to about 435° C.

The hydrocarbon stream in the reaction zone is preferably maintained under a superatmospheric pressure typically above about 1,000 pounds per square inch absolute (psia). The high pressure serves to maintain volatile components in the hydrocarbon stream in liquid phase. The pressure also maintains products and by-products from the oxidation reaction and thermal cracking reaction in solution in the hydrocarbon stream. It is important to maximize the liquid phase in the reaction zone to minimize the concentration of asphaltenes and other coke precursors to avoid their precipitation from the hydrocarbon phase and possible deposition on internal reactor surfaces with subsequent coke formation. A small volume fraction of the stream can be in vapor phase and, in fact, a small volume of vapor phase can be beneficial in promoting mixing of the stream for rapid distribution of heat from the oxidation reaction throughout the core portion of the stream. Preferably the vapor phase should amount to no more than about 10 volume percent of the hydrocarbon stream. If the vapor phase comprises a substantial percent of the stream volume, it can become difficult to maintain a pressure balance in the reactor vessel.

As discussed hereinabove, at least a portion of the pressure on the hydrocarbon stream is achieved by a hydrostatic column of fluid. If it is desired that the reaction pressure be greater than that generated by the hydrostatic head, the initial pressure of the hydrocarbon feed stream can be increased by using a pumping means for example, centrifugal or positive displacement pumps, to provide the desired total reaction pressure. The feed stream to the influent conduit may be pumped in one or more stages.

Upon introduction of the oxidizing agent into the hydrocarbon stream, oxidation of components of the stream occurs upon contact with the oxidizing agent. In a localized area immediately downstream from introduction of the agent, the temperature of the stream can be substantially higher than the reaction temperature because the oxidation reaction occurs essentially upon contact of the agent with hydrocarbon materials and is substantially complete before the heat generated by the reaction is distributed in the stream. The use of oxygen as the oxidizing agent results in essentially a flame front in the hydrocarbon stream. It is desirable to very quickly distribute the heat from the oxidation reaction throughout the core portion to produce a substantially uniform temperature in the core portion, i.e. essentially a uniform bulk temperature. Mixing of the core portion ordinarily occurs essentially immediately as a result of turbulent flow of the hydrocarbon stream within the reaction vessel. If the flow velocity of the stream is low enough that the stream is in laminar flow, mixing can be induced with, for example, static mixers.

The rate at which the oxidizing agent is introduced into the hydrocarbon stream can be conveniently expressed as an amount of oxidizing agent per unit volume of the hydrocarbon stream. The flow rate of the oxidizing agent is controlled so that the heat generated by the oxidation reaction does not increase the bulk temperature of the hydrocarbon stream above the coking temperature. For example, in a typical operation in which the hydrocarbon stream comprises whole crude oil and oxygen is the oxidizing agent, the flow rate of oxygen is preferably less than about 40 scf/bbl (standard cubic feet per barrel), more preferably less than about 30 scf/bbl and most preferably less than about 20 scf/bbl.

The primary gaseous product of the oxidation reaction has been found to be carbon dioxide, which correlates closely with introduction of oxygen to the reactor. Other gases are also produced as by-products of the present process; however, these appear to correlate with temperature fluctuations in the stream rather than the combustion reaction. The major component of this gas make has been found to be methane, although substantial amounts of carbon monoxide may be present as well, with smaller amounts of ethane, propane, hydrogen, carbon monoxide, and hydrogen sulfide also being produced.

In the direct oxidative heating process, it is important to maintain a positive pressure at the point of introduction of the oxidizing agent into the stream. Otherwise, the hydrocarbon feed can flow into the oxidizing agent feedline possibly resulting in a violent oxidation reaction. Safe operation of the process therefore, requires that the oxidizing agent be at a pressure greater than the pressure of the feed at the point of injection. To maintain a positive oxidizing agent flow and prevent the danger of hydrocarbon backup into the oxidizing agent addition line, a pressure drop across the injection nozzle of at least about 50 psi, and more preferably about 100 psi is preferred.

For safety reasons, it is also preferred to provide an emergency system in the event of a mechanical failure in the injection system. Such an emergency system floods the injection line with a non-reactive gas, such as nitrogen, during an injection system failure to prevent hydrocarbon material from entering the injection line and producing an explosive reaction with the oxidizing agent.

The spatial placement of the oxidizing agent injection nozzle can significantly affect the temperature of regions of the boundary layer as well as the reactor vessel wall. If the nozzle is placed within the core portion of the hydrocarbon stream close to the boundary layer, the resulting oxidation reaction can heat the boundary layer and the reactor vessel and cause substantial coke formation on the vessel. Likewise, if the injection nozzle is placed centrally within the core portion of the hydrocarbon stream but is directed toward a reactor wall or other surface, the resulting reaction can overheat the boundary layer and reactor vessel. Another danger associated with placement of the oxidizing agent injection nozzle is that if the nozzle is too near the reactor vessel wall or is pointed toward the reactor vessel wall, the oxidation reaction can degrade or melt the wall causing a system failure. In operation of the process, the oxidizing agent injection nozzle is preferably in a substantially central position in the core portion of the hydrocarbon stream and is directed to provide a flow of oxidizing agent substantially parallel to the flow of the hydrocarbon stream. This placement of the nozzle acts to localize the oxidation reaction within the core portion of the hydrocarbon stream away from the boundary layer, thereby minimizing the temperature in the boundary layer.

The injection nozzle should also be oriented relative to the flow of the hydrocarbon stream so that heat generated by the oxidation reaction is carried away from the nozzle to prevent thermal degradation of the nozzle itself. Injection of the oxidizing agent in the same direction as the flow of the hydrocarbon stream, given a sufficient flow rate, successfully removes heat from the nozzle.

Heat loss to the outside environment from the central portion of the stream outward is anticipated as heat is generated internally by direct oxidative heating. Some heat loss can occur even if the reactor vessel is insulated. Consequently, it may be necessary to use multiple sites for introduction of oxidizing agents to provide sufficient heat for viscosity reduction or to maintain a given temperature for a longer time than possible with a single injection site. In this embodiment, the injection sites are spaced so that as the bulk temperature of the stream falls below a temperature at which acceptable viscosity reduction is occurring, the stream passes another injection site to provide additional heat.

The instant invention can be more readily understood after a description of preferred embodiments. As will be understood by those skilled in the art, other apparatuses and configurations can be used in the practice of the present invention.

FIG. 1 depicts a subterranean vertical reactor 2 disposed in a well bore 4. The term "vertical" is used herein to mean that the tubular reactor is disposed toward the earth's center. It is contemplated that the tubular reactor can be oriented several degrees from true vertical, i.e. normally within about 10 degrees.

The reactor can be disposed within the well bore such that the outer reactor wall serves as the well casing or such that an annulus 5 is formed between the outer reactor wall and the bore wall. In the latter embodiment, the well bore can be cased. In the embodiment in which there is an annulus, heat loss to the surrounding earth is minimized by filling the annulus 5 with an insulating cement. Filling the annular space with cement serves three purposes in addition to insulating the reaction vessel: (1) it supports the outer conduit vertically; (2) it isolates the various formation zones and prevents communication of fluids and hydrocarbons between them; and (3) it fills the void space around the outer conduit and prevents subsequent sloughing.

The influent and effluent conduits of the reactor can be arranged as concentric inner conduit 10 and outer conduit 14, with the influent and effluent conduits comprising the inner and outer conduits respectively, or alternately comprising the outer and inner conduits respectively. These alternate configurations allow the flow of the hydrocarbon stream to be in either direction.

Figure 2:
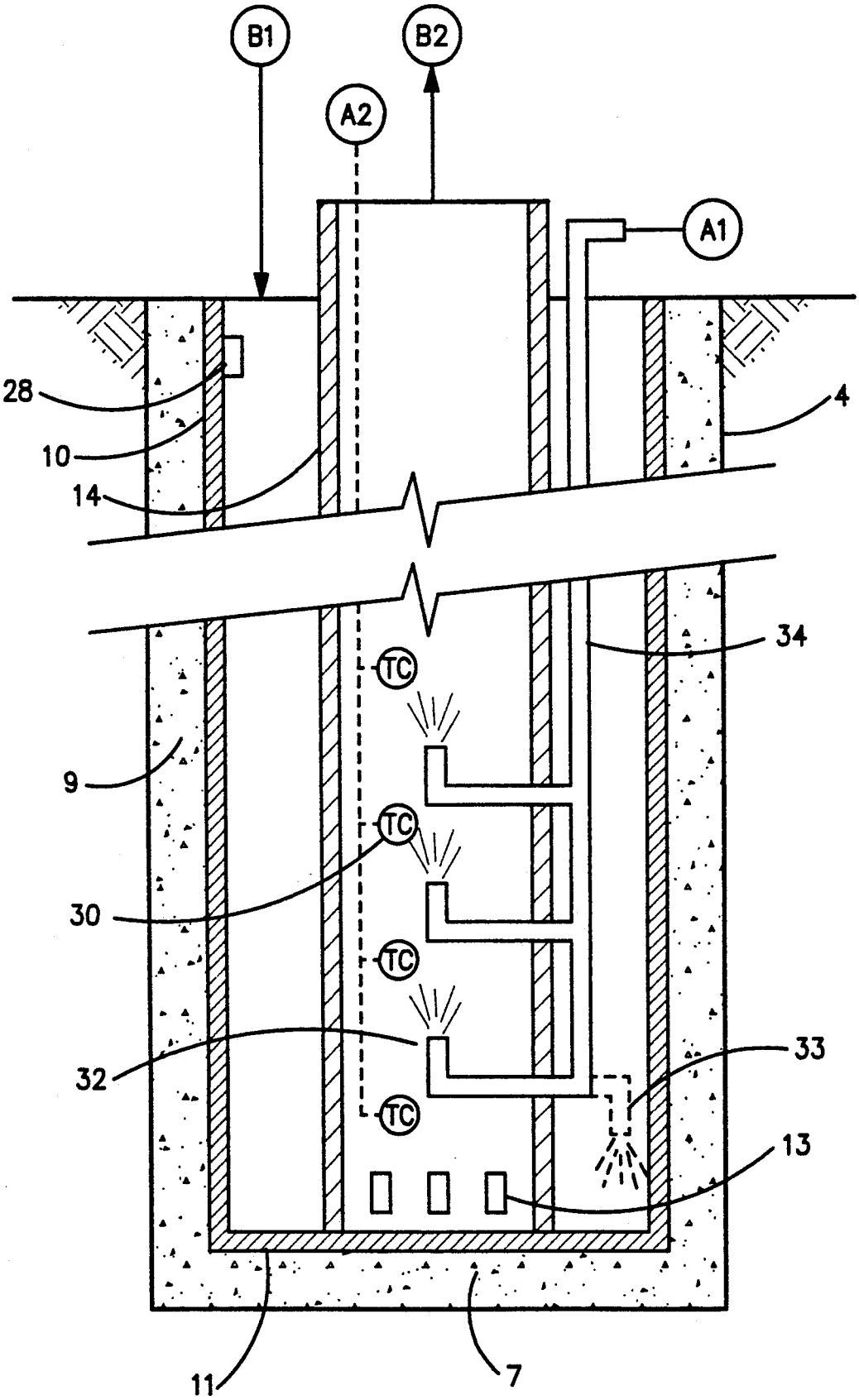
FIG. 2 is a schematic representation of another preferred embodiment of the present invention.
Figure 3:
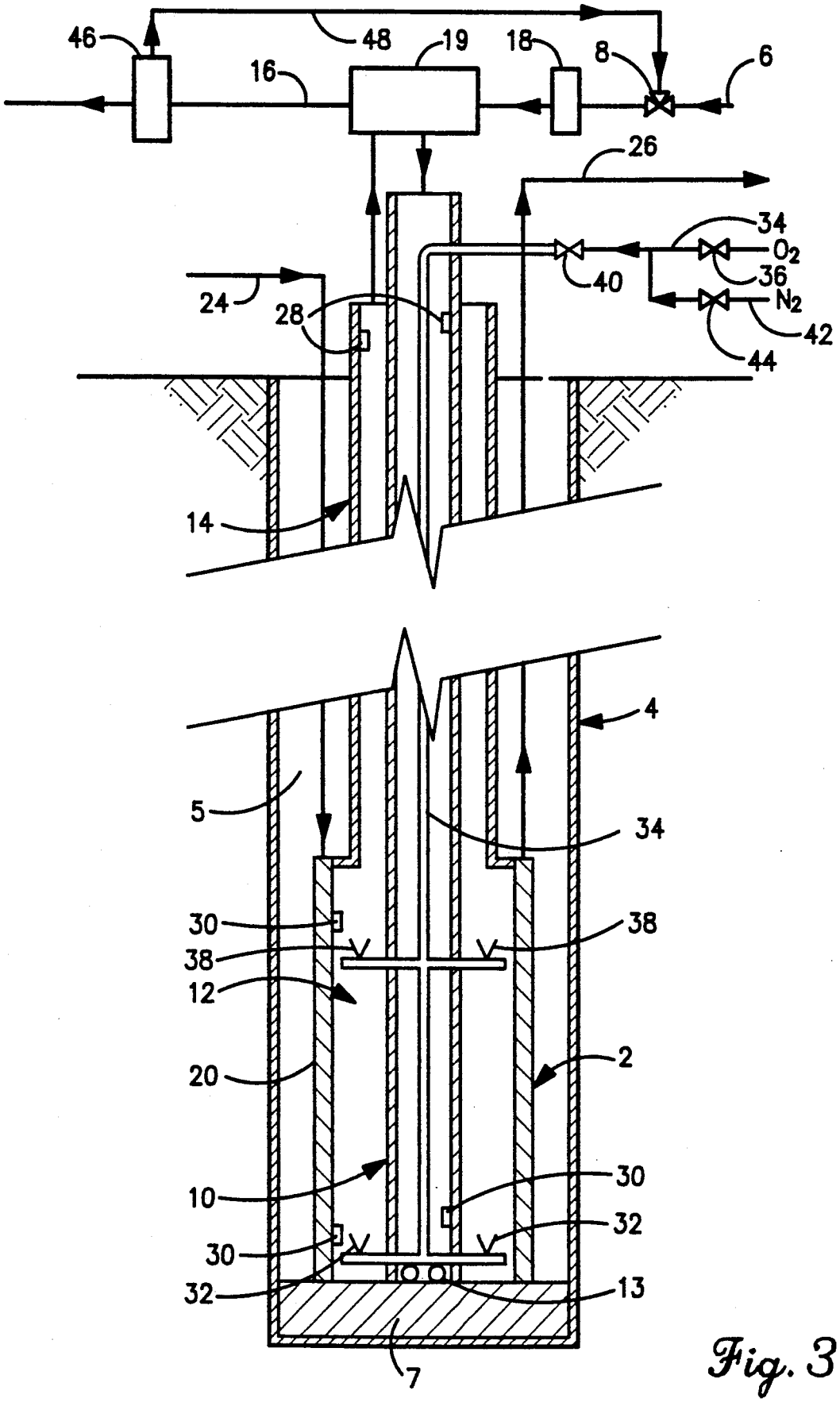
FIG. 3 is a schematic representation of a third preferred embodiment of the present invention.

In the embodiment depicted in FIGS. 1 and 3, the outer conduit is closed at the bottom of the well bore with a suitable material 7 such as cement. In the embodiment of FIG. 2, the outer conduit is closed by an end piece and is suspended such that it terminates above the bottom of the well bore.

The inner conduit can terminate above the enclosure material as depicted in FIG. 1, or it can terminate in and be restrained by the enclosure material 7, as depicted in FIG. 3. Alternately, the inner conduit can connect with the end piece of the outer conduit as illustrated in FIG. 2. In the FIG. 2 embodiment, the inner conduit can either be attached to the end piece of the outer conduit or be merely resting on it.

In any of the embodiments for the inner conduit, thermal expansion during start up must be accommodated. In the configuration of FIG. 3 in which the terminal ends of the inner and outer conduits are restrained by a material such as cement, the inner conduit is stressed an amount equal to the thermal expansion expected during warm up. Likewise, in the embodiment of FIG. 2 in which the inner conduit is attached to the end piece of the outer conduit, the inner conduit is stressed an amount equal to the thermal expansion expected during warm up. Such a construction allows the inner conduit to be in a relaxed state during operation of the thermal treatment process. Fluid communication between inner and outer conduits in FIGS. 2 and 3 is provided by the placement of openings 13 in the inner conduit wall near the bottom of the conduit.

In a preferred embodiment depicted in FIG. 1 in which the inner conduit is suspended above the enclosure material 7, thermal expansion is accommodated by suspending the inner conduit such that it terminates a sufficient distance above the outer conduit closure to allow for thermal expansion during warm up. The terminating and opening of the inner conduit provides fluid communication between inner and outer conduits during operation although additional openings in the sides of the conduit can be provided as desired.

The preferred construction materials used for the influent and effluent conduits depend on the nature of the hydrocarbon feed and the particular operating conditions. The hydrocarbon feed or crude can contain corrosives, such as hydrogen sulfide, naphthenic acid, polythionic and inorganic salts, or components that will generate said acids and salts under the operating conditions used. Additionally, the feed can contain water which can increase corrosion particularly by inorganic salts present in the feed. Corrosion by such agents can be minimized by the selection of appropriate materials. A combination of materials may be necessary to resist all corrosive agents present in a feed. The acid and salt corrosion rates for construction materials vary with temperature.

For naphthenic acid corrosion, which is greatest at temperatures above 450° F., type 316L stainless steel, which contains molybdenum, is a preferred material of construction. For polythionic acid corrosion, types 347 or 347H stabilized stainless steel are preferred materials of construction. However, if both naphthenic and polythionic acid corrosion are of concern, then type 316L is a preferred construction material. For inorganic salt corrosion, which is normally greatest in areas of water phase separation, Monel is a preferred material of construction. Water phase separation is more likely at those depths of the reactor where the hydrostatic pressure is sufficient to liquify water vapor, even though temperatures can be 200° C. to 450° C.

If the hydrocarbon feed contains hydrogen sulfide, naphthenic acid, polythionic and inorganic salts, and water phase separation is likely, the following materials are preferred:

in high temperature regions (at least 450° F.), type 316 L stainless steel;

in low temperature regions (below 450° F.), at depths where water phase separation is likely, Monel; and in low temperature regions (below 450° F.) at depths where water phase separation does not exceed 10% by weight of the stream, carbon steel.

If the hydrocarbon feed contains hydrogen sulfide, naphthenic acid, polythionic acid and inorganic salts, but no more than 10% water phase separation is anticipated, the following materials can be used:

in high temperature regions (at least 450° F.), type 316L stainless steel; and in low temperature regions (below 450° F.), carbon steel or 316L stainless steel.

Although either carbon steel or 316L can be used in low temperature regions, use of 316L minimizes the replacement of equipment due to corrosion.

In a preferred embodiment depicted in FIG. 1, the outer effluent conduit 14 is concentrically arranged around the inner influent conduit 10. The flow of the untreated hydrocarbon feed stream is directed through line 6 and into influent conduit 10 to the reaction zone 12 and up the concentric effluent conduit 14. This arrangement provides for heat exchange between the outgoing product stream and the incoming feed stream. During start up, untreated hydrocarbon feed is introduced into the vertical tube reactor system through feed inlet 6, the flow rate being controlled by a metering means such as valve 8. The hydrocarbon feed stream passes through influent conduit 10 into reaction zone 12 and up through concentric effluent conduit 14 exiting through discharge line 16. During this operation unless external heat is provided to the hydrocarbon feed stream, the initial temperature $T_1$ is equal to the final heat exchange temperature $T_2$ and is also equal to the maximum temperature in the reaction zone $T_{rx}$ (assuming no heat loss to the environment). In order to achieve the necessary temperature $T_2$ at which oxidant can advantageously be introduced, the hydrocarbon stream is heated. This heating can be accomplished by an above-ground heating means 18. The heating means may be any of a variety of heaters known to those skilled in the art, such as a fired heater which uses gaseous fuel recovered in the surface facilities and/or supplemental fuel. The necessary heat can also be provided by an external heating means 20 surrounding the reaction zone. Preferably, external heating means 20 is a jacket surrounding the reaction zone through which a heat exchange fluid is passed through inlet line 24 and outlet line 26. Normally, this mode of operation is used when the outer conduit receives the influent stream. In another configuration not shown, the influent conduit 10 can also be jacketed to allow external heating of the hydrocarbon stream at this location in addition to or instead of heating the reaction zone. Alternatively, the external heating means 20 can be used in conjunction with the above ground heating means 18 to provide the hydrocarbon feed stream at the desired temperature $T_2$. Normally, the feed stream is recycled through the vertical reactor until the desired temperature ($T_2$) is reached.

The temperature of the hydrocarbon stream is determined by temperature monitors 30 which can be located in the hydrocarbon stream throughout the vertical tube reactor system. Under normal operating conditions, it is preferred that there be one temperature monitor located downstream of each injector within the reaction zone.

As the hydrocarbon stream passes down through influent conduit 10, pressure on any particular volume segment increases due to the hydrostatic column of fluid above that volume segment in the stream. Under normal operating conditions, it is preferred that no pressure monitors be located within the reaction zone. Instead, pressure is preferably monitored at pressure monitors 28 located at the inlet and/or outlet of the reactor. The pressure in the reaction zone can be calculated by summing the pressure at the reactor inlet or outlet and the pressure exerted by the hydrostatic column of fluid at the depth corresponding to the reaction zone. The pressure exerted by the hydrostatic column can be readily calculated by a skilled artisan.

Once the desired temperature $T_2$ has been attained by external heating of the hydrocarbon stream, oxidant is introduced through line 34 and nozzles 32 to provide the incremental heat necessary to reach the desired reaction temperature.

The nozzles for introducing the oxidizing agent are arranged in the conduits according to the desired method of operation. If the influent or effluent conduits are the outer and inner conduits respectively, the nozzles can be placed in one or both of the influent and/or effluent conduits. Alternately, if the influent and effluent conduits are the inner and outer conduits respectively, the nozzles can be placed in one or both of the influent and/or effluent conduits. In each of these embodiments, the orientation of the oxidant injection nozzle are in the direction of flow of the hydrocarbon stream. In the preferred embodiment of FIG. 1, the effluent conduit is the outer concentric conduit 14 and the oxidant is directed upward into the upflowing hydrocarbon stream in the effluent conduit at nozzles 32.

Flow rate of the oxidant is controlled by a metering means such as valve 36 which in turn can be controlled directly or indirectly by output from selected temperature monitors 30 and/or pressure monitors 28. Output from temperature monitor 30 and pressure monitor 28 can also be used to control, directly or indirectly, other factors that determine temperature. These can include the temperature of media in the jacket 20 providing external heat to the reaction zone and/or the influent hydrocarbon stream pump rate. Temperature monitors are typically thermocouple devices. A means can be provided for receiving a signal from the thermocouple and adjusting the oxidizing agent metering means to adjust the flow of oxidizing agent in order to maintain the temperature of the hydrocarbon stream in the reaction zone within a preselected range of temperatures. Although manual adjustment can be used for controlling oxidant flow, automated adjusting or metering means is preferred. For example, a proportional controller with reset or a proportional integrated controller can be used.

The number of nozzles in the reaction zone is determined by the quantity of heat required to produce the desired increase in temperature from $T_2$ to $T_{rx}$. The demand for a high rate of product output (short transit time in the reaction zone) and/or for a significant reduction in viscosity requires a greater input of heat energy. To provide greater heat input, a plurality of oxidant injection nozzles can be employed. Additional oxidant injection nozzles 38 can be provided downstream from the initial nozzles 32. The downstream nozzles are sufficiently distanced downstream from upstream nozzles to avoid damage from the flamefront associated with upstream nozzles. Under normal operating conditions, it is expected that about three to ten nozzles are located in the reaction zone. In a preferred embodiment depicted in FIG. 1, the initial nozzles 32 are located near the bottom of the effluent conduit 14. Additional nozzles 38 can be located downstream of the initial nozzles. This configuration provides the advantage that vapor phase regions formed during the oxidation reaction readily flow upward with the product stream. In an embodiment where the nozzles are placed in the influent conduit, static or slowly moving vapor phase regions or bubbles could be formed in the influent conduit. This could disrupt flow of the hydrocarbon stream, cause pressure fluctuations, and/or result in reduced heat exchange.

The material used in the construction of the nozzles depends on the operating temperature in the reaction zone and the corrosion as well as the erosion characteristics of the feedstream. For example, 316L steel can be used where naphthenic acid corrosion is of concern. Other materials which can be used to prepare the nozzle or the nozzle tip include ceramics and tungsten carbide materials.

As discussed hereinabove, for safety reasons it is important to maintain a positive pressure in line 34 relative to the pressure of the hydrocarbon at the oxidant injection nozzle. This prevents hydrocarbon feed from flowing into the oxidizing agent feed line 34 possibly resulting in a violent oxidation reaction. Therefore, the oxidizing agent should be at a pressure greater than the pressure of the hydrocarbon feed at the point of injection. Nitrogen can be introduced into line 34 through line 42 with the flow being controlled by a metering means such as valve 44. Ordinarily, in operation line 34 is purged with nitrogen prior to introduction of oxidizing agent. For safety purposes, an emergency system can be provided in which valve 44 is activated and non-reactive gas introduced into line 34 in the event oxidant flow is interrupted. Normally, a device such as a check valve 40 is present in the line 34 to prevent reverse flow of feed into the oxidant supply. A means for detecting oxidant flow rate can also be placed in line 34. Oxidant flow rate is typically determined by measuring the change in pressure over a segment of oxidant line 34 at or near the surface.

The oxidant conduits that supply oxidizing agent to the nozzles can be arranged in any convenient configuration. In the embodiment of FIG. 1, oxidant conduit 34 is positioned along the external surface of the reactor outer conduit to the level at which the nozzles are placed. At this point, the oxidant conduit penetrates the reactor outer conduit wall and connects with the nozzles. In the event the nozzles are located within the reactor inner conduit, the oxidant conduit penetrates the reactor inner conduit wall.

In another embodiment, the oxidant conduit traverses the external surface of the reactor inner conduit until it reaches nozzle level, at which point it extends to and connects with the nozzle. The oxidant conduit penetrates the wall reactor inner conduit if a nozzle is located in the inner conduit.

In a third, more-preferred embodiment illustrated in FIG. 3, the oxidant conduit is positioned down the inside of the reactor inner conduit. The oxidant conduit branches at the level at which a nozzle is located and connects therewith. Other embodiments for positioning the oxidant conduit will be apparent to those skilled in the art and are encompassed herein.

A preferred construction material for the oxidant conduits is molybdenum containing Inconel 625 because of its corrosion resistance to an aqueous, high temperature environment containing $O_2$. Due to its molybdenum content, Inconel 625 also has resistance to naphthenic acid corrosion.

The temperature of the effluent product stream can be lower than the reaction temperature when it initially comes in heat exchange contact with the influent stream due to some heat loss to the environment. The temperature of the effluent product stream is continually decreased by thermal communication with the influent stream until a final temperature ($T_f$) is attained as the effluent exits the reactor system.

The effluent hydrocarbon stream passes upward through effluent conduit 14 and out of heat exchange contact with influent hydrocarbon feed stream exiting the reactor through line 16. The product can pass to a separation/compression unit 46 in which carbon dioxide and other gases are separated from liquid product and a more volatile fraction of the hydrocarbon stream can also be segregated. The separation/compression unit 46 is a combination of separators and compressors operated at selected temperatures and pressures for the purpose of separating desired gaseous and liquid hydrocarbon fractions. Volatile components usually boiling below about 40° C. can be recycled through line 48 into the influent hydrocarbon feed stream. This can be done to induce vertical multiphase flow in the influent stream to substantially increase the efficiency of heat exchange between the influent and effluent streams. The volatile liquid fraction recycled to the influent conduit is of a composition such that it is in the gaseous phase under pressure existing during the heat exchange process between the influent and effluent streams and in a liquid phase under the greater pressures existing below the heat exchange area in the reaction zone.

During start up when external heat is being supplied to increase the temperature of the hydrocarbon stream, the complete stream can be recycled, for example, through line 48 in order to minimize the total volume of hydrocarbon which must be heated by external means. When the desired temperature $T_2$ has been attained for the hydrocarbon stream in the reactor system, heat from the external heat source can be terminated. In FIG. 3, the effluent stream is brought into thermal communication with the influent stream in an above-ground heat exchanger 19 to provide a higher initial temperature of the influent stream. The above-ground heat exchanger additionally provides a safety mechanism in the event of fouling downstream in the reactor vessel. The above-ground exchanger can be any of a variety of exchangers known to those skilled in the art, including a shell-and-tube exchanger. Shell-and-tube exchanger construction material can be carbon steel if the operating temperature of the exchanger is below 450° F. If the operating temperature is above 450° F., the shell can be composed of carbon steel overlaid with type 316L, and the tubes can be composed entirely of 316L.

FIG. 2 depicts an embodiment in which the flow of the hydrocarbon stream is in the opposite direction from that of FIGS. 1 and 3. The outer conduit functions as an influent conduit 10, while the inner conduit functions as an effluent conduit 14. FIG. 2 also differs from FIG. 1 in that the inner conduit 14 is connected to an end piece 11 which closes the terminal end of the outer conduit 10. The terminal end of the inner conduit 14 may merely rest on end piece 11 or may be detachably fixed thereto. Fixing the inner conduit to the end piece in a detachable manner allows for removal of the inner conduit from the reactor for cleaning purposes. The inner conduit can be detachably affixed to the end piece using for example, a female threaded coupling device formed in the end piece and adapted to receive and retain the threaded terminal end of the inner conduit.

Insulating cement 9 is depicted in the annulus between the well bore wall 4 and the outer influent conduit 10. Oxidant nozzles 32 are located in the effluent conduit 14, but may alternately be located in both the effluent conduit 14 and influent conduit 10, as indicated by the placement of phantom nozzle 33 in the influent nozzle 10. The location of the phantom nozzle is representative only and not definitive with respect to actual or relative location Actual location would be determined by the desired span of the reaction zone.

Figure 2A:
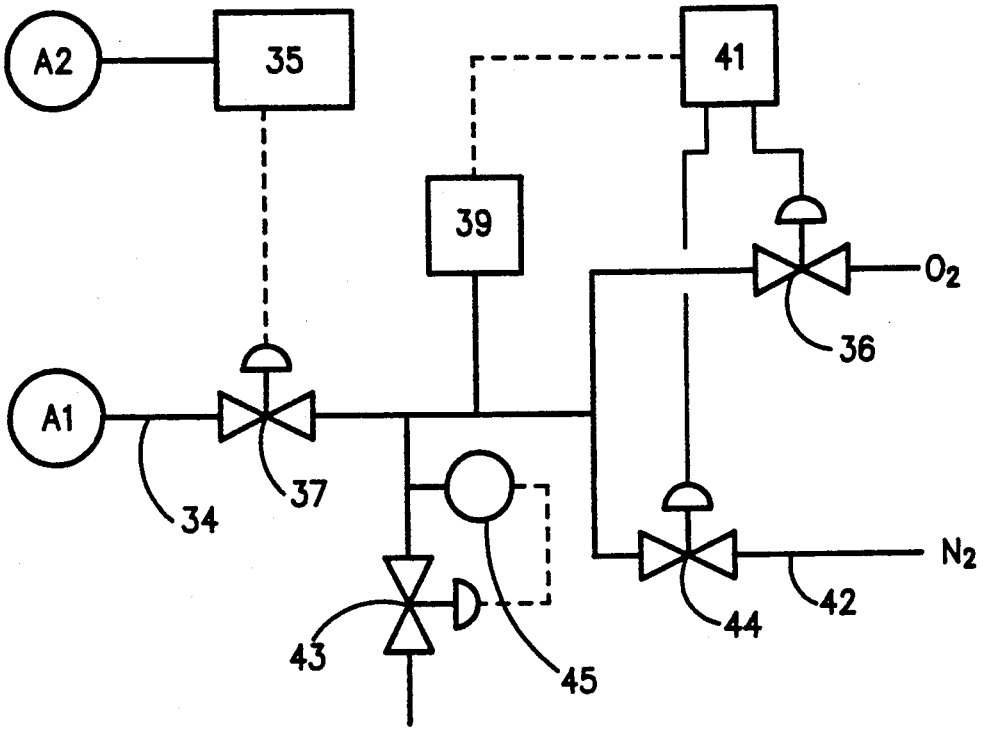
FIG. 2A is a schematic representation of an embodiment of the oxidant flow control system and oxygen and nitrogen delivery system for the reactor apparatus of FIG. 2.

FIG. 2A depicts a mechanism for controlling the oxidant flow rate in response to temperature monitor output shown in association with FIG. 2. Symbols "A1" and "A2" represent points of relation between FIGS. 2 and 2A. Flow controller 35 receives a signal from the temperature detector thermocouples 30 of FIG. 2 and adjusts the metering means 37 on oxidant line 34. As output from the thermocouples 30 indicates excessive temperatures in the reaction zone, flow controller 35 sends a signal to metering means 37 to reduce oxidant flow rate. As output from the thermocouples 30 indicates reaction zone temperatures below a preselected range, flow controller 35 activates the metering means 37 to increase oxidant flow rate. Also depicted in FIG. 2A is a gas analyzer 39 connected to means for differential control 41 of oxygen to nitrogen ratio in the oxidant supply line. In response to quantitative analysis of gases in line 34, the means for differential control 41 of oxygen and nitrogen adjusts valves 36 and 44 to bring the ratio of said gases into a preselected range. A vent mechanism 43, controlled by a pressure sensor 45 on line 34, is activated to release gases from line 34 when the pressure therein exceeds a preselected limit.

Figure 2B:
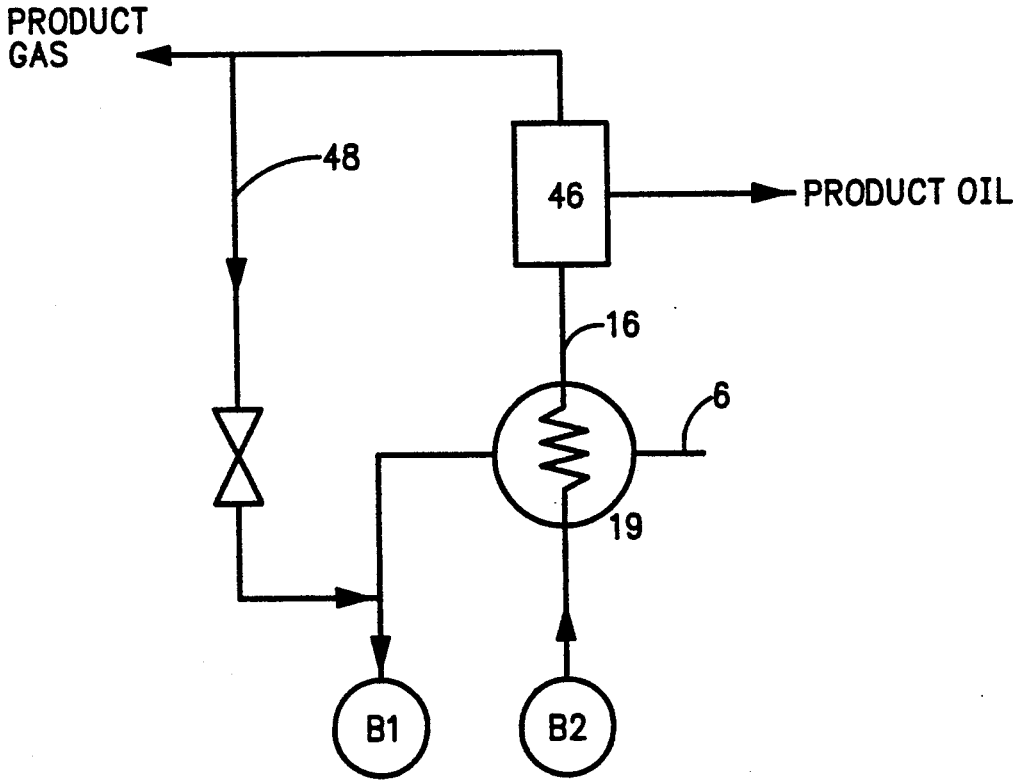
FIG. 2B is a schematic representation of an embodiment of the surface facilities associated with the reactor apparatus of FIG. 2.

FIG. 2B depicts the surface facilities associated with the reactor embodiment of FIG. 2. Symbols "B1" and "B2" represent points of relation between FIGS. 2 and 2B. Above-ground heat exchanger 19 brings incoming hydrocarbon feed in line 6 into heat exchange contact with the effluent product stream. Product stream in line 16 then enters the separation/compression unit 46 for separation of a volatile fraction from the liquid product. The volatile fraction can be recycled through line 48 to influent conduit 14 to induce vertical multiphase flow in the influent stream to substantially increase the efficiency of heat exchange in the reactor between the influent and effluent streams.

In the embodiment of FIG. 3, the flow of the hydrocarbon stream is the same as in FIG. 1. FIG. 3 features an above ground heat exchanger 19 that brings effluent and influent streams into heat exchange contact outside of the reactor itself. The oxidant supply line 34 of FIG. 3 travels within and substantially parallel to the influent conduit 10 and branches at appropriate depths to supply nozzles 32 and 38. Oxidant control valve 44 allows for control of the oxidant flow rate at nozzles 32 and 38. Check valve 40 on oxidant supply line 34 is present to prevent reverse flow of hydrocarbon feed into the oxidant supply.

While various embodiments of the present invention have been described in detail, it is apparent that modifications and adaptations will occur to those skilled in the art. However, it is to be expressly understood that such modifications and adaptations are within the spirit and scope of the present invention, as set forth in the following claims.

We claim:

1. A vertical tube reactor apparatus disposed within a substantially vertical well bore, said apparatus being suitable for reducing the viscosity of hydrocarbons, said apparatus comprising:

(a) an influent conduit in fluid communication with an effluent conduit comprising concentrically arranged inner and outer conduits, each having an upper and a lower zone, wherein said influent conduit is said inner conduit and said effluent conduit is said outer conduit, said influent conduit adapted to receive an influent hydrocarbon stream and conduct said influent stream substantially downward, and said effluent conduit adapted to conduct an effluent product stream substantially upward, wherein said conduits provide heat-exchange contact between influent stream and said effluent product stream to produce a heated influent stream;

(b) an oxidant injection nozzle located within said effluent conduit so as to introduce oxidant into the core portion of said heated influent stream substantially parallel to the flow of said stream to produce an effluent product stream;

(c) means for sensing temperature located within at least one of said lower zones downstream from said nozzle, said means producing an output proportional to said temperature;

(d) a conduit extending to the surface of the well bore and being connected to the nozzle for conducting oxidant from the surface of the well bore to said nozzle, said oxidant conduit including a flow metering means and being located within said well bore and travelling substantially parallel to said influent and effluent conduits; and, (e) a means for controlling the flow rate of said oxidant within said oxidant conduit, said control means being operatively associated with said metering means and said temperature sensing means so as to be responsive to the output from said temperature sensing means and adjust said oxidant flow rate in a preselected proportion to said output.

2. A vertical tube reactor apparatus disposed within a substantially vertical well bore, said apparatus being suitable for reducing the viscosity of hydrocarbons, said apparatus comprising:

(a) an influent conduit in fluid communication with an effluent conduit comprising concentrically arranged inner and outer conduits, each having an upper and a lower zone, wherein said influent conduit is said inner conduit and said effluent conduit is said outer conduit, said influent conduit adapted to receive an influent hydrocarbon stream and conduct said influent stream substantially downward, and said effluent conduit adapted to conduct an effluent product stream substantially upward, wherein said conduits provide heat-exchange contact between influent stream and said effluent product stream to produce a heated influent stream;

(b) an oxidant injection nozzle located within said effluent conduit so as to introduce oxidant into the core portion of said heated influent stream substantially parallel to the flow of said stream to produce an effluent product stream;

(c) a means for sensing temperature located within at least one of said lower zones downstream from said nozzle, said means producing an output proportional to said temperature;

(d) a conduit extending to the surface of the well bore and being connected to the nozzle for conducting oxidant from the surface of the well bore to said nozzle wherein said oxidant conduit includes a flow metering means and is located within said inner conduit and travels downward to connect with said nozzle; and, (e) a means for controlling the flow rate of said oxidant within said oxidant conduit said control means being operatively associated with said metering means and said temperature sensing means so as to be responsive to the output from said temperature sensing means and adjust said oxidant flow rate in a preselected proportion to said output.

3. A vertical tube reactor apparatus, suitable for reducing the viscosity of hydrocarbons, disposed within a substantially vertical well bore, said apparatus comprising:

an influent conduit in fluid communication with an effluent conduit, each conduit having an upper and a lower zone, said influent conduit adapted to receive an influent hydrocarbon stream and conduct said influent stream substantially downward, and said effluent conduit adapted to conduct an effluent stream substantially upward, wherein in said upper zones said conduits are adapted to bring said influent stream and said effluent stream into heat exchange contact and heat said influent stream to a bulk temperature to produce a heated hydrocarbon stream;

(b) at least one oxidant injection nozzle located within at least one of said lower zones so as to introduce oxidant into the core portion of said heated hydrocarbon stream substantially parallel to the flow of said stream, said oxidant injection nozzle located at a combustion zone of the reactor apparatus, wherein the bulk temperature of said heated hydrocarbon stream is sufficient to provide raped and substantially complete oxidation of a portion of the hydrocarbon stream upon contact of the oxidant with the hydrocarbon stream, heat generated from said oxidation further heating said heated hydrocarbon stream in a reaction zone of the reactor apparatus to produce said product stream;

(c) means for sensing pressure located within said conduits, said means producing an output proportional to said pressure;

(d) a conduit extending to the surface of the well bore and being connected to the nozzle for conducting oxidant from the surface of the well bore to said nozzle, said oxidant conduit including a flow metering means;

(e) means for controlling the flow rate of said oxidant within said oxidant conduit said oxidant control means being operatively associated with said metering means and being responsive to the output from said pressure sensing means for adjusting said oxidant flow rate in a preselected proportion to said output; and (f) second flow control means for controlling a rate of flow of the influent hydrocarbon stream, said second flow control means including a second flow metering means in fluid communication with said influent conduit, said second control means being operatively associated with said second metering means and with said pressure sensing means so as to be responsive to said output from said pressure sensing means and to adjust said hydrocarbon stream rate of flow in a preselected proportion to said output.

* * * * *

UNITED STATES PATENT AND TRADEMARK OFFICE

CERTIFICATE OF CORRECTION

PATENT NO. : 5,008,085

DATED : April 16, 1991

INVENTOR(S) : Richard L. Bain and John R. Larson

It is certified that error appears in the above-identified patent and that said Letters Patent is hereby corrected as shown below:

Column 1, line 54, after "Land" insert a comma.

Column 2, line 3, after "Titmas" insert a comma.

Column 2, line 17, after "McGrew" insert a comma.

Column 2, line 32, after "Bain" insert a comma.

Column 17, line 34, after the first occurrence of "location" insert a period.

Column 18, line 47 (line 24 of Claim 1), insert --a-- before "means".

Column 19, line 42 (line 5 of Claim 3), before the first occurrence of "an" insert --(a)--.

Column 20, line 14 (line 25 of Claim 3), delete "raped" and insert therefor --rapid--.

Signed and Sealed this

Sixth Day of October, 1992

*Attest:*

*Attesting Officer*

DOUGLAS B. COMER

*Acting Commissioner of Patents and Trademarks*